US009980323B2

(12) United States Patent
Hirata et al.

(10) Patent No.: US 9,980,323 B2
(45) Date of Patent: May 22, 2018

(54) HIGH-FREQUENCY HEATING COOKER

(71) Applicant: PANASONIC CORPORATION, Osaka (JP)

(72) Inventors: Junji Hirata, Shiga (JP); Osamu Muranaka, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 401 days.

(21) Appl. No.: 14/432,709

(22) PCT Filed: Sep. 26, 2013

(86) PCT No.: PCT/JP2013/005727
§ 371 (c)(1),
(2) Date: Mar. 31, 2015

(87) PCT Pub. No.: WO2014/054252
PCT Pub. Date: Apr. 10, 2014

(65) Prior Publication Data

US 2015/0250029 A1 Sep. 3, 2015

(30) Foreign Application Priority Data

Oct. 2, 2012 (JP) ..... 2012-220011

(51) Int. Cl.
*H05B 6/68* (2006.01)
*H05B 6/64* (2006.01)
*H05B 6/66* (2006.01)

(52) U.S. Cl.
CPC ..... *H05B 6/642* (2013.01); *H05B 6/666* (2013.01)

(58) Field of Classification Search
CPC ..... H05B 6/666; H05B 6/642
(Continued)

(56) References Cited

U.S. PATENT DOCUMENTS 4,831,239 A * 5/1989 Ueda ..... H05B 6/64 219/518
5,283,410 A * 2/1994 Kim ..... H05B 6/6411 177/145

FOREIGN PATENT DOCUMENTS

JP 62-299624 A 12/1987
JP 64-16514 U 1/1989
(Continued)

OTHER PUBLICATIONS

International Preliminary Report on Patentability and Written Opinion, and English language translation thereof, in corresponding International Application No. PCT/JP2013/005727, dated Apr. 16, 2015, 13 pages.

(Continued)

*Primary Examiner* — Quang Van
(74) *Attorney, Agent, or Firm* — Brinks Gilson & Lione

(57) ABSTRACT

A high-frequency heating cooker of the invention includes a high-frequency generating device that generates a high-frequency wave to be supplied to a heating chamber, a cooling device that blows air to cool the high-frequency generating device, an air intake opening that takes the air blown from the cooling device disposed on a first side plate of the heating chamber to cool the high-frequency generating device into the heating chamber, an exhaust opening disposed on a second side plate of the heating chamber to discharge the air taken into the heating chamber from the air intake opening out of the heating chamber, an exhaust guide plate disposed between the second side plate and a side plate of a housing, and an excessive temperature rise preventing device disposed on the exhaust guide plate, the exhaust guide plate having an eaves structure above the excessive temperature rise preventing device.

6 Claims, 9 Drawing Sheets

(58) Field of Classification Search
USPC ..... 219/757, 702, 704, 707, 708, 710, 719; 99/325, 326, 327, DIG. 14; 341/165, 341/160; 700/299
See application file for complete search history.

(56) References Cited

FOREIGN PATENT DOCUMENTS

| | | | |
|---|---|---|---|
| JP | 4-47298 | U | 4/1992 |
| JP | 4-74206 | U | 6/1992 |
| JP | 11-159769 | A | 6/1999 |

OTHER PUBLICATIONS

International Search Report, and English language translation thereof, in corresponding International Application No. PCT/JP2013/005727, dated Nov. 12, 2013, 5 pages.

* cited by examiner

HIGH-FREQUENCY HEATING COOKER

This application is a 371 application of PCT/JP2013/005727 having an international filing date of Sep. 26, 2013, which claims priority to JP 2012-220011 filed Oct. 2, 2012, the entire contents of which are incorporated herein by reference.

TECHNICAL FIELD

The invention relates to a high-frequency heating cooker having an excessive temperature rise preventing device that detects an abnormal temperature rise inside a heating chamber to stop driving of a high-frequency generator.

BACKGROUND ART

Conventionally, this type of high-frequency heating cooker (e.g., microwave oven) is configured to heat a heating-target object such as a food placed inside a heating chamber by a high-frequency generator such as a magnetron. In the conventional high-frequency heating cooker, it is possible that, by an excessive heating of the heating-target object, the heating-target object burns, the temperature of the heating chamber is raised to an abnormal temperature, flames spread to the outside of the high-frequency heating cooker, and a fire breaks out.

FIG. 7 is a perspective view of an internal structure of the high-frequency heating cooker of a first conventional example (see, e.g., Patent Document 1: Japanese Unexamined Patent Publication No. 1987-299624). As shown in FIG. 7, in the high-frequency heating cooker of the first conventional example, an excessive temperature rise preventing device 104 such as a temperature switch is disposed at an end on the exhaust opening 103 side of a top plate 102 of a heating chamber 101. This excessive temperature rise preventing device 104 detects an abnormal temperature rise inside the heating chamber 101 and breaks a power supply to a high-frequency generator (not shown), thereby preventing flames from spreading to the outside of the high-frequency heating cooker.

FIG. 8 is a perspective view of the internal structure of the high-frequency heating cooker of a second conventional example. The high-frequency heating cooker of the second conventional example, as an apparatus that heats the heating-target object, has a heater 105 in addition to the high-frequency generator (not shown). The heater 105 has its heating part disposed along the inner surface of the top plate 102 so that it can bake the surface of the heating-target object placed inside the heating chamber 101.

In the case of disposing the heater 105 on the top plate 102, the temperature of the top plate rises rapidly when the heater 105 is energized. For this reason, when the excessive temperature rise preventing device 104 is disposed on the top plate 102, the excessive temperature rise preventing device 104 can erroneously detect the temperature rise of the top plate 102 as the abnormal temperature rise inside the heating chamber 101.

For this reason, in the high-frequency heating cooker of conventional example 2, the excessive temperature rise preventing device 104 is disposed on an exhaust guide plate 106 with its upper end fixed to the top plate 102 of the heating chamber 101 to face the exhaust opening 103. This sets the excessive temperature rise preventing device 104 apart from the heater 105, preventing an erroneous detection of the excessive temperature rise preventing device 104. Sensitivity of the excessive temperature rise preventing device 104 is enhanced by disposing it in the vicinity of the exhaust opening 103. To suppress the temperature rise of a side plate of a housing of the high-frequency heating cooker, the exhaust guide plate 106 guides the air discharged from the exhaust opening 103 not to hit the side plate directly.

PATENT DOCUMENT

Patent Document 1: Japanese Unexamined Patent Publication No. 1987-299624

SUMMARY OF THE INVENTION

Problems to be Solved by the Invention

In the high-frequency heating cooker of the first conventional example, water can penetrate onto the top plate 102 of the heating chamber 101 through openings communicating with the outside such as an external exhaust opening 107A disposed on a back plate 107 and the water can attach to the excessive temperature rise preventing device 104. Moisture contained in the air discharged from the exhaust opening 103 can result in dew condensation and the water caused by this dew condensation can attach to the excessive temperature rise preventing device 104.

Likewise, in the high-frequency heating cooker of the second conventional example, the water that penetrated onto the top plate 102 and the water caused by the dew condensation can move from the upper end to the lower end of the exhaust guide plate 106 and attach to the excessive temperature rise preventing device 104.

The excessive temperature rise preventing device 104 functions as a charging unit and, if wet with water, comes to the state of being incapable of satisfying insulation properties and has a possibility of electric shocks.

Therefore, it is an object of the invention to solve the problem of the conventional art and provide a high-frequency heating cooker capable of suppressing attachment of water to an excessive temperature rise preventing device.

Means to be Solved the Problem

In order to solve the problem of the conventional art, a high-frequency heating cooker according to the invention includes:

a housing;

a heating chamber disposed inside the housing to contain an heating-target object;

a high-frequency generating device that generates a high-frequency wave to be supplied to the inside of the heating chamber;

a cooling device that blows air to cool the high-frequency generating device;

an air intake opening that is disposed on a first side plate of the heating chamber and takes the air blown from the cooling device to cool the high-frequency generating device into the heating chamber;

an exhaust opening that is disposed on a second side plate confronting the first side plate of the heating chamber and discharges the air taken into the heating chamber from the air intake opening out of the heating chamber;

an exhaust guide plate that is disposed between the second side plate of the heating chamber and a side plate of the housing and guides the air discharged from the exhaust opening so that the air does not directly hit the side plate of the housing; and an excessive temperature rise preventing device that is disposed on the exhaust guide plate and detects an abnormal temperature rise inside the heating chamber to stop driving of the high-frequency generating device, wherein the exhaust guide plate has an eaves structure above the excessive temperature rise preventing device.

Effect of the Invention

According to the high-frequency heating cooker of the invention, attachment of water to the excessive temperature rise preventing device can be suppressed by providing an eaves structure above the excessive temperature rise preventing device.

BRIEF DESCRIPTION OF THE DRAWINGS

These aspects and features of the invention will be apparent from the following description concerning a preferred embodiment with reference to the accompanying drawings, in which.

DETAILED DESCRIPTION OF THE PREFERRED EMBODIMENTS

Figure 1:
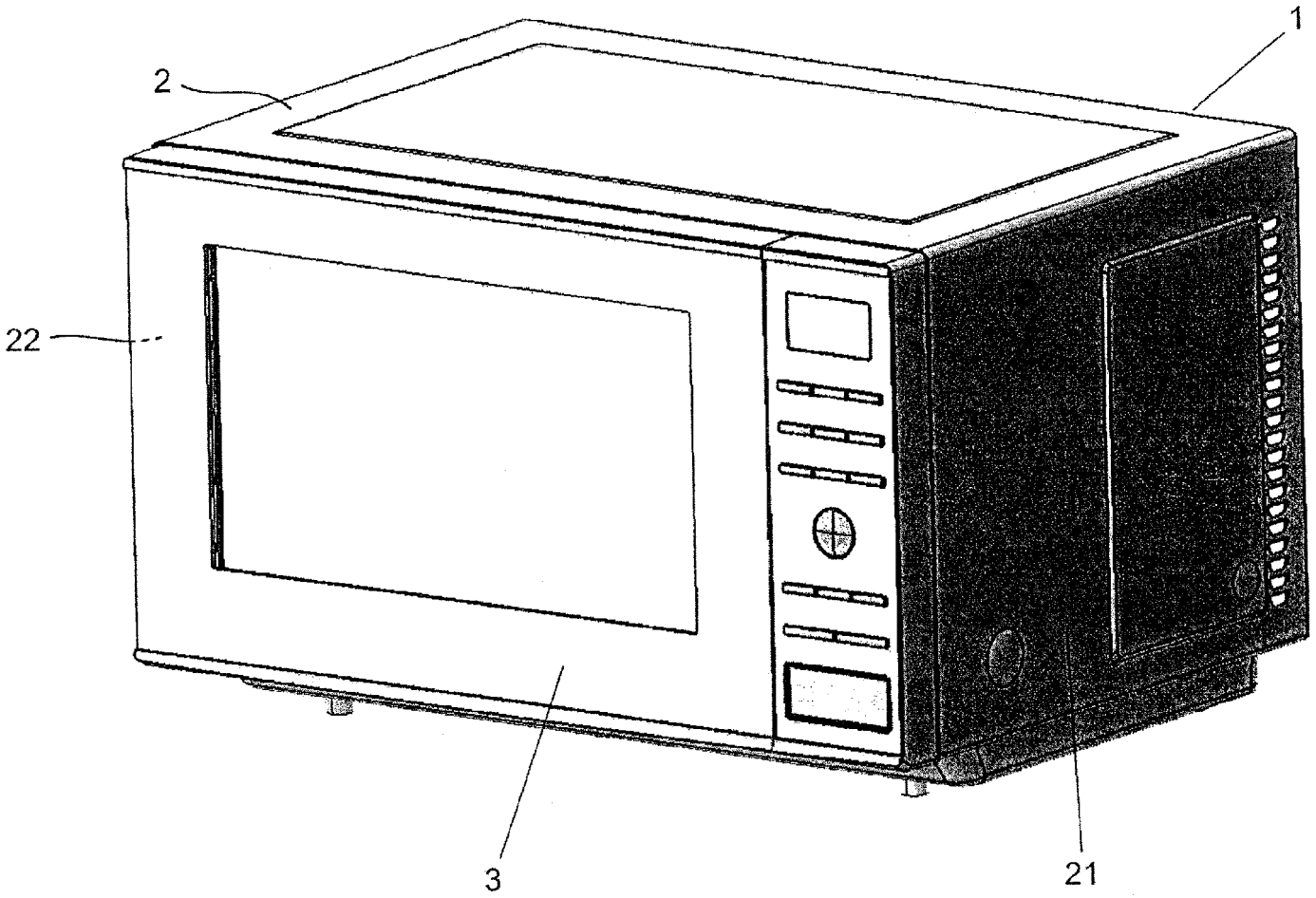
FIG. 1 is an external perspective view of a high-frequency heating cooker according to an embodiment of the invention.

A high-frequency heating cooker according to the invention includes:

a housing;

a heating chamber disposed inside the housing to contain an heating-target object;

a high-frequency generating device that generates a high-frequency wave to be supplied to the inside of the heating chamber;

a cooling device that blows air to cool the high-frequency generating device;

an air intake opening that is disposed on a first side plate of the heating chamber and takes the air blown from the cooling device to cool the high-frequency generating device into the heating chamber;

an exhaust opening that is disposed on a second side plate confronting the first side plate of the heating chamber and discharges the air taken into the heating chamber from the air intake opening out of the heating chamber;

an exhaust guide plate that is disposed between the second side plate of the heating chamber and a side plate of the housing and guides the air discharged from the exhaust opening so that the air does not directly hit the side plate of the housing; and an excessive temperature rise preventing device that is disposed on the exhaust guide plate and detects an abnormal temperature rise inside the heating chamber to stop driving of the high-frequency generating device, wherein the exhaust guide plate has an eaves structure above the excessive temperature rise preventing device.

According to this configuration, attachment of water to the excessive temperature rise preventing device can be suppressed by the exhaust guide plate having the eaves structure above the excessive temperature rise preventing device.

Preferably, the exhaust guide plate has a concave part recessed to be close to the exhaust opening at a portion confronting the exhaust opening, and the excessive temperature rise preventing device is disposed on the concave part. According to this configuration, the eaves structure can be composed by a simple processing of disposing the concave part on the exhaust guide plate.

Preferably, a depth dimension of the concave part is larger than a height dimension of the excessive temperature rise preventing device. According to this configuration, the attachment of the water to the excessive temperature rise preventing device can be suppressed further.

Preferably, the concave part is formed to be recessed over an entire width in a width direction of the exhaust guide plate. According to this configuration, an end in a lateral direction of the excessive temperature rise preventing device can be prevented from getting into contact with the exhaust guide plate and the entire width of the exhaust guide plate can be made as small as an entire width of the excessive temperature rise preventing device.

Preferably, the exhaust guide plate has a guide part that guides the air discharged from the exhaust opening toward an external exhaust opening disposed on a back plate of the housing. According to this configuration, the air discharged from the exhaust opening hitting the side plate of the housing can be suppressed and the temperature rise of the side plate of the housing can be suppressed further.

Preferably, an upper end of the exhaust guide plate is fixed to the heating chamber, and a lower end of the exhaust guide plate is fixed to a bottom plate of the housing, located below the heating chamber to support the heating chamber. According to this configuration, a positional deviation of the exhaust guide plate can be suppressed. The heating chamber and the bottom plate can be reinforced and an easy deformation of the heating chamber and the bottom plate can be suppressed even if a shock is applied from the outside of the high-frequency heating cooker.

Preferably, the high-frequency heating cooker further includes a spacer that is disposed between the exhaust guide plate and the side plate of the housing and presses the exhaust guide plate so that a part of the exhaust guide plate comes into contact with the second side plate of the heating chamber. According to this configuration, the positional deviation of the exhaust guide plate can be suppressed. For example, when a fan motor is used as a cooling device, it is possible that the heating chamber vibrates and the second side plate of the heating chamber and the exhaust guide plate get into contact with each other, resulting in generation of vibration noise. By contrast, according to the above configuration, the vibration noise can be suppressed by disposing the spacer as described above.

An embodiment will now be described with reference to the drawings. The invention is not intended to be limited by this embodiment.

Embodiment

Figure 2:
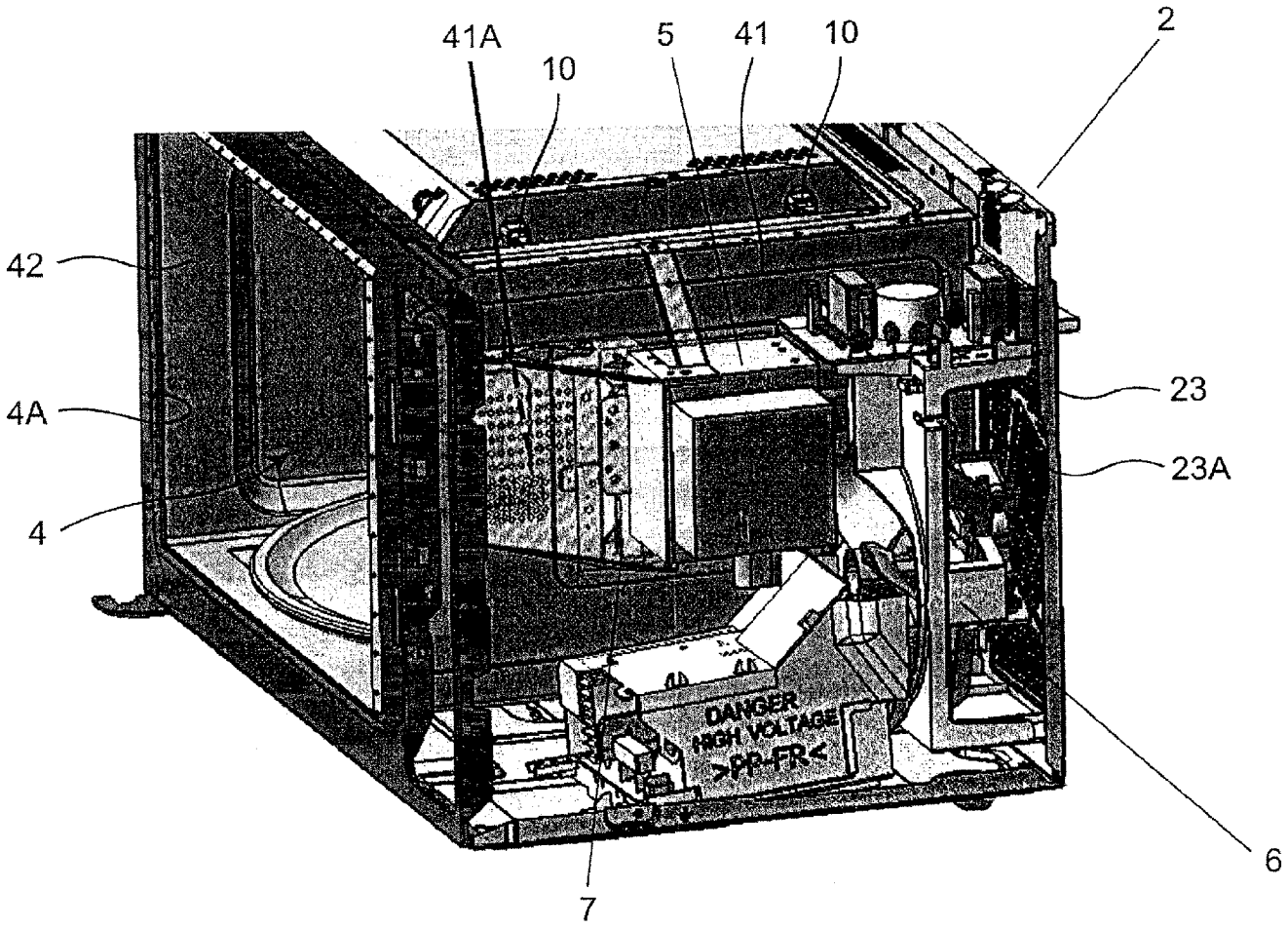
FIG. 2 is a perspective view of an internal structure on the air intake opening side of the high-frequency heating cooker according to the embodiment of the invention.
Figure 3:
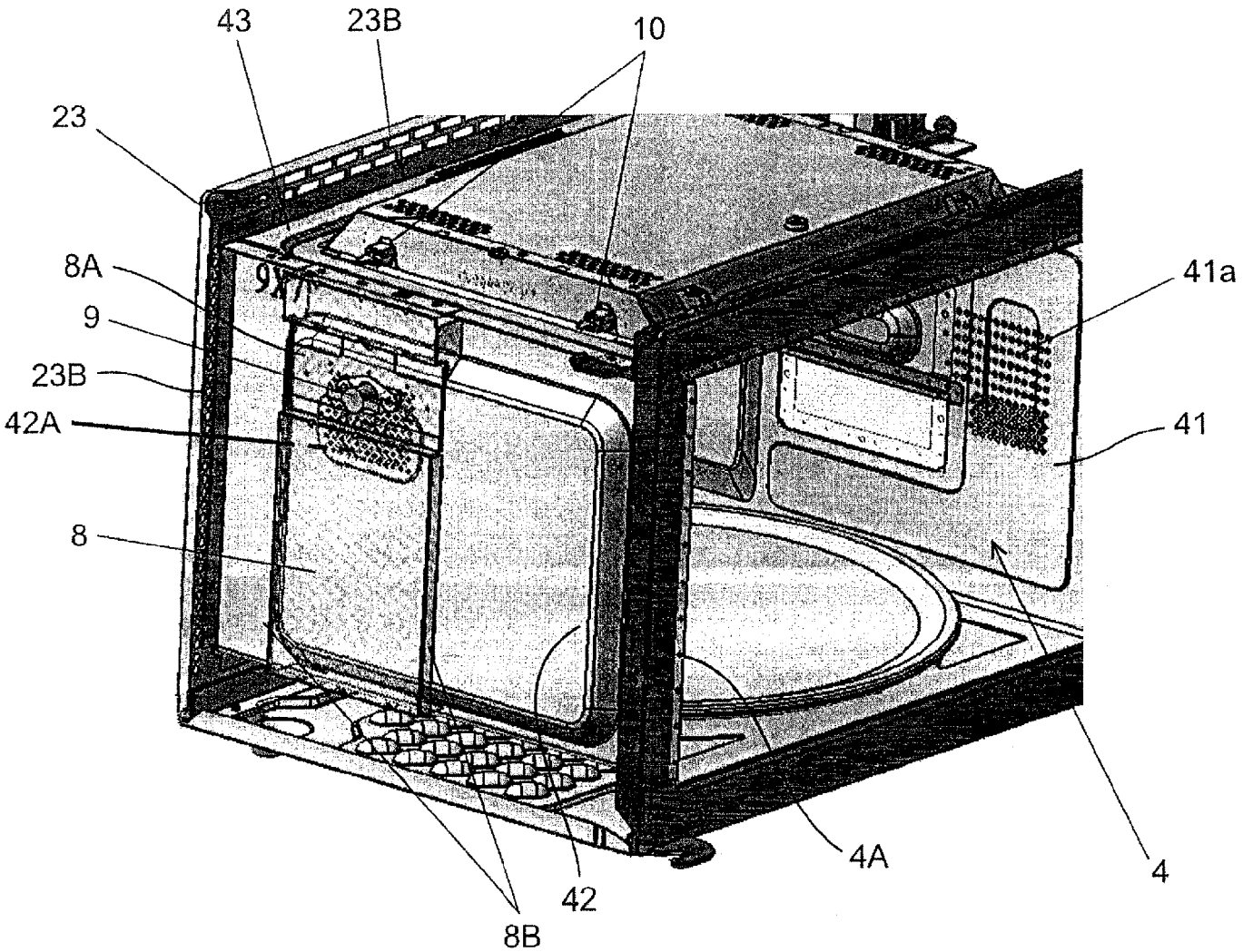
FIG. 3 is a perspective view of the internal structure on the exhaust opening side of the high-frequency heating cooker according to the embodiment of the invention.

FIG. 1 is an external perspective view of the high-frequency heating cooker according to an embodiment of the invention. FIG. 2 is a perspective view of an internal structure on the air intake opening side of the high-frequency heating cooker of FIG. 1. FIG. 3 is a perspective view of the internal structure on the exhaust opening side of the high-frequency heating cooker of FIG. 1.

In FIG. 1, a high-frequency heating cooker 1 according to this embodiment has a housing 2 as an enclosure. A door 3 is disposed to be freely openable and closable at the front of the housing 2.

As shown in FIG. 2, a heating chamber 4 to contain the heating-target object is disposed inside the housing 2. An outlet for ejecting the heating-target object 4A is disposed at the front of the heating chamber 4. The outlet 4A is opened or closed by the opening or the closing of the door 3.

As shown in FIGS. 1 and 2, a magnetron 5 as an example of a high frequency generator and a cooling device 6 are disposed in a space between a right side plate (external plate) 21 of the housing 2 and a right side plate (first side plate) 41 of the heating chamber.

The magnetron 5 generates a high-frequency wave to be supplied to the inside of the heating chamber 4. The magnetron 5 is fixed to the right side plate 41 of the heating chamber 4. The high-frequency wave generated by the magnetron 5 is supplied to the inside of the heating chamber 4 through a waveguide (not shown).

The cooling device 6 blows air to cool the magnetron 5. The cooling device 6 is arranged between the magnetron 5 and a back plate 23 of the housing 2. An outside air intake opening 23A to take in the outside air is disposed on the back plate 23 of the housing 2. The cooling device 6 blows the air took in from the outside air intake opening 23A as the air to cool the magnetron 5.

On the right side plate 41 of the heating chamber 4, an air intake opening 41A is disposed to take the air blown out by the cooling device 6 to cool the magnetron 5 into the heating chamber 4. An air intake guide plate 7 is disposed in front of the magnetron 5. The air blown from the cooling device 6 to cool the magnetron 5 is guided by the air intake guide plate 7 to the air intake opening 41A.

As shown in FIG. 3, on a left side plate 42 confronting the right side plate 41 of the heating chamber 4, an exhaust opening 42A is disposed to discharge the air taken into the heating chamber 4 from the air intake opening 41A out of the heating chamber 4.

Between the left side plate 42 of the heating chamber 4 and a left side plate 22 (see FIG. 1) of the housing 2, an exhaust guide plate 8 is disposed to guide the air discharged from the exhaust opening 42A so that it will not directly hit the left side plate 22 of the housing 2. An upper end of the exhaust guide plate 8 is fixed to a top plate 43 of the heating chamber 4 by, for example, a fastening member such as a screw. At such part of the exhaust guide plate 8 that confronts the exhaust opening 42A, a concave part 8A is formed that is recessed to be close to the exhaust opening 42A. An excessive temperature rise preventing device 9 such as a temperature switch is disposed on the concave part 8A.

The excessive temperature rise preventing device 9 detects an abnormal temperature rise inside the heating chamber 4 and stops driving of the magnetron 5. For example, the excessive temperature rise preventing device 9 is configured to break a power supply to the magnetron 5 when a predetermined temperature is exceeded. The excessive temperature rise preventing device 9 may be configured to break the power supply not only to the magnetron 5 but also to all other devices.

A heater 10 is disposed on the top plate 43 of the heating chamber 4. The heater 10 has its heating part disposed along the inner surface of the top plate so that it can bake the surface of the heating-target object placed inside the heating chamber 4.

Next, a configuration will be described in more detail of the exhaust guide plate 8.

Figure 4A:
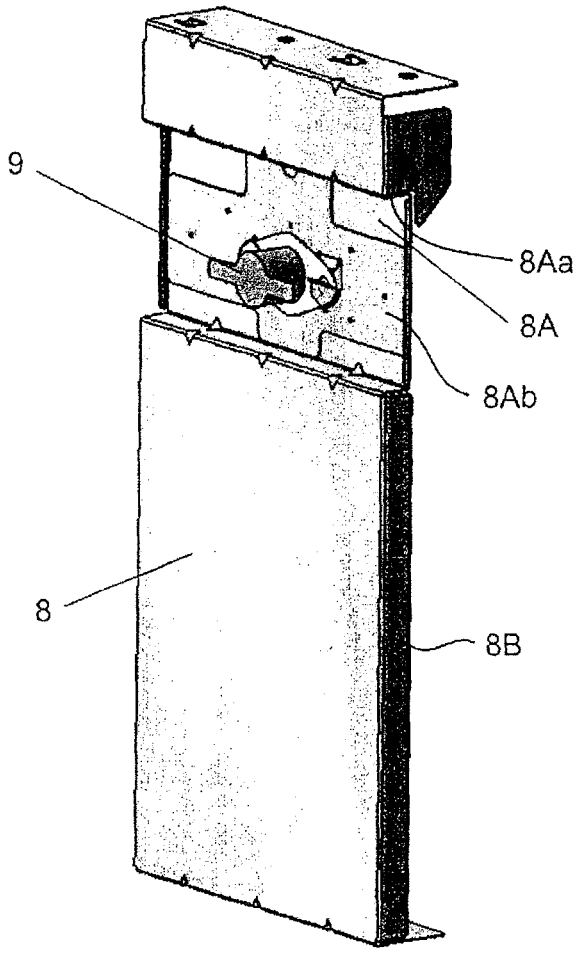
FIG. 4A is a perspective view of an exhaust guide plate possessed by the high-frequency heating cooker of FIG. 1.

When a wiring of the excessive temperature rise preventing device 9 is taken into account, an entire width of the excessive temperature rise preventing device 9 including the wiring becomes considerably large. For this reason, in this embodiment, the concave part 8A of the exhaust guide plate 8 is formed to be recessed over the entire width in the width direction, as shown in FIG. 4A. This makes it possible to prevent an end in the width direction of the excessive temperature rise preventing device 9 from getting into contact with the exhaust guide plate 8 and make the entire width of the exhaust guide plate 8 as small as the entire width of the excessive temperature rise preventing device 9 including the wiring.

Figure 4B:
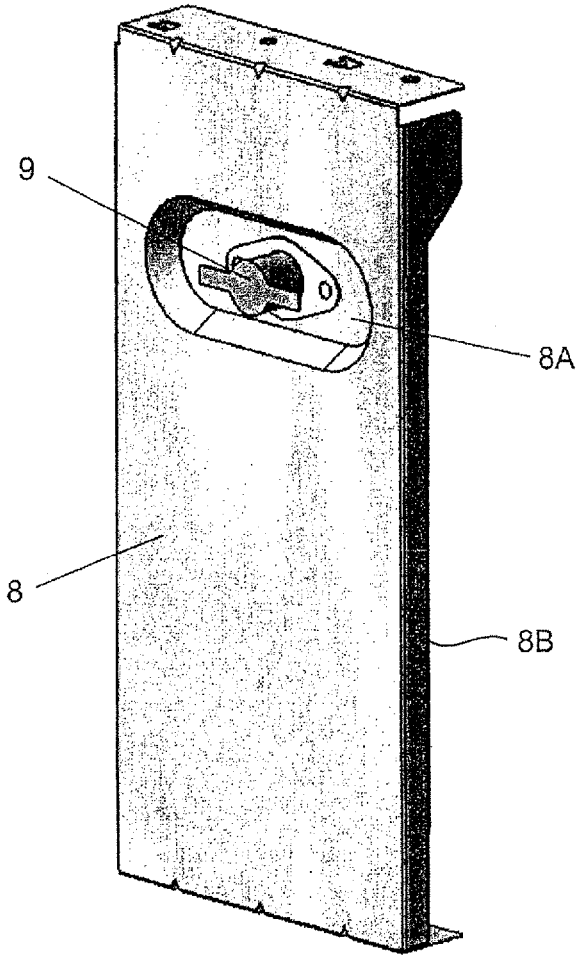
FIG. 4B is a perspective view of a variation example of the exhaust guide plate of FIG. 4A.

When it is possible to enlarge the entire width of the exhaust guide plate 8, the concave part 8A of the exhaust guide plate may be formed to have a bottomed cylindrical shape as shown in FIG. 4B. In this case, a mold for forming the exhaust guide plate 8 can be simplified.

A depth dimension of the concave part 8A should preferably be larger than a height dimension of the excessive temperature rise preventing device 9. This makes it possible to further suppress the attachment of the water to the excessive temperature rise preventing device 9.

As shown in FIG. 4A, the angle formed by the upper side surface 8Aa of the concave part 8A and the bottom surface 8Ab of the concave part 8A should preferably be 90 degrees or less than 90 degrees. This makes it possible to suppress the water, which flows from the upper end toward the lower end of the exhaust guide plate 8, flowing along the surface of the concave part 8A and further suppress the attachment of the water to the excessive temperature rise preventing device 9.

As shown in FIGS. 3, 4A, and 4B, the exhaust guide plate 8 should preferably have a guide part 8B that guides the air discharged from the exhaust opening 42A toward external exhaust openings 23B disposed on the back plate 23 of the housing 2. This makes it possible to suppress the air discharged from the exhaust opening 42A hitting the left side plate 22 of the housing 2 and further suppress the temperature rise of the left side plate 22 of the housing 2.

Figure 8:
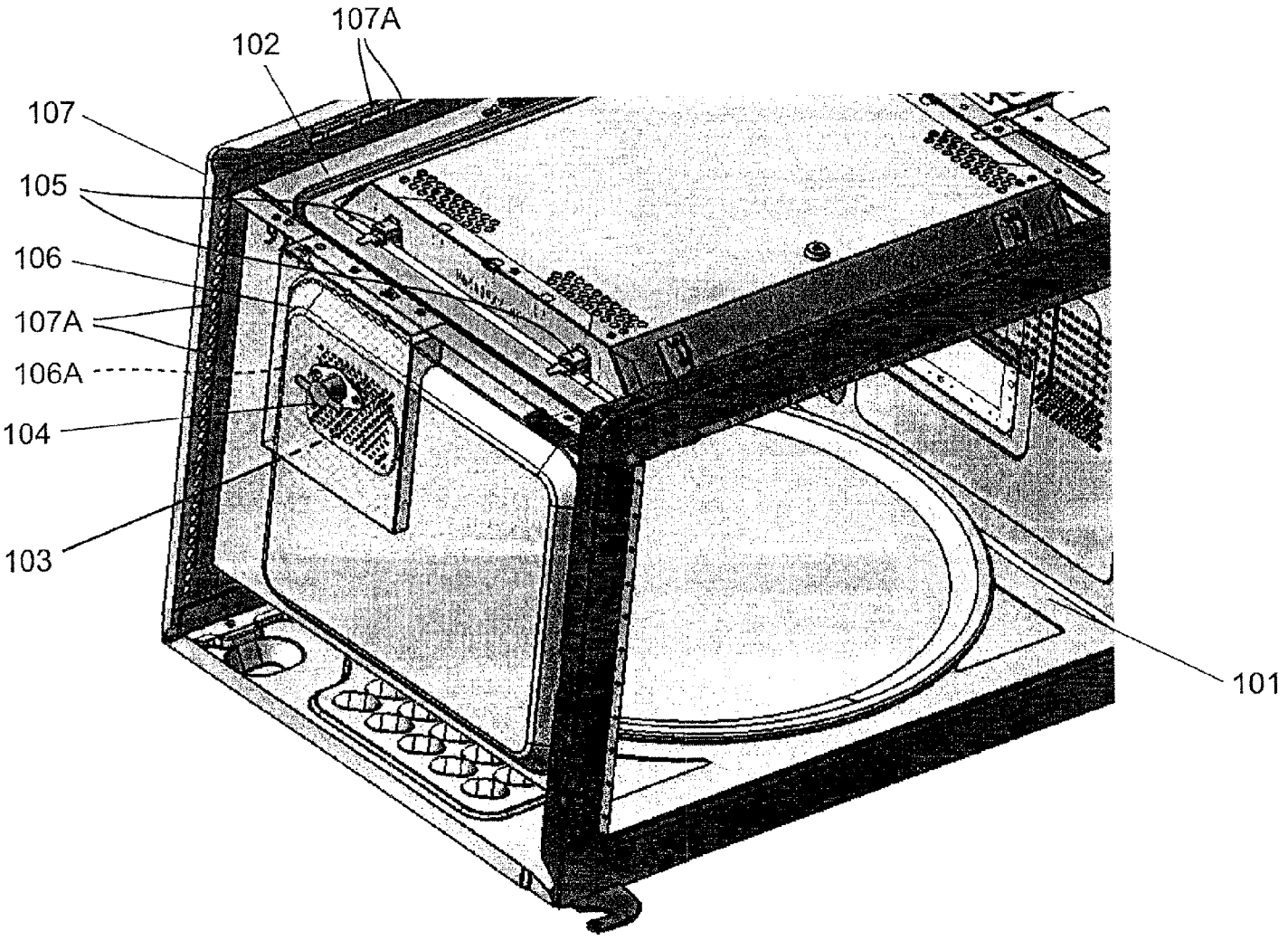
FIG. 8 is a perspective view of the internal structure of the high-frequency heating cooker of a second conventional example and is a diagram of a configuration of disposing the excessive temperature rise preventing device on a side plate of the heating chamber.

In the exhaust guide plate 106 of the second conventional example shown in FIG. 8, a side plate 106A is disposed on the side of the external exhaust opening 107A disposed on the back plate 107 and the exhaust guide plate 106 is opened downward. For this reason, the air discharged from the exhaust opening 103 goes downward and thereafter, goes toward the external exhaust opening 107A and therefore, the temperature of the left side plate 22 of the housing 2 is more likely to increase than in this embodiment.

The guide part 8B should preferably be formed by bending a side part of the exhaust guide plate 8. By this, the guide part 8B can be processed more easily than by forming it with a separate member and the effect can be obtained of enhancing the strength of the exhaust guide plate 8.

Figure 5A:
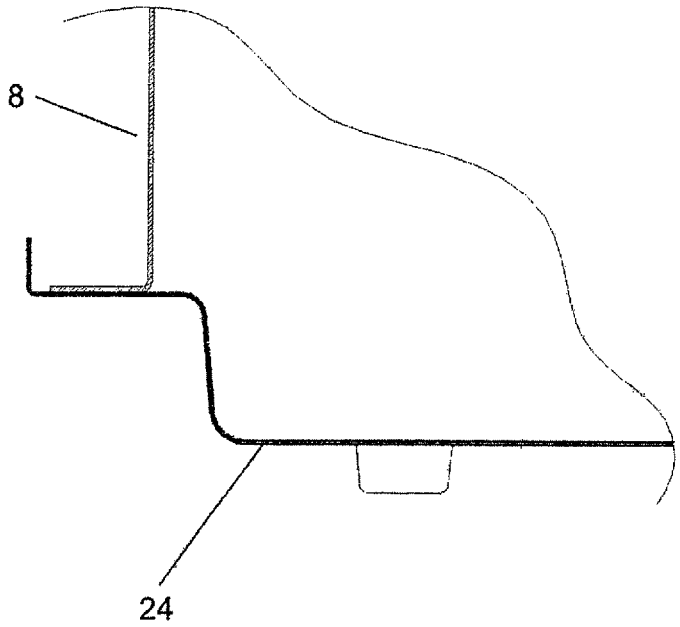
FIG. 5A is a cross-sectional view of a first configuration example of fixing a lower end of the exhaust guide plate to a bottom plate of a housing.

As shown in FIG. 5A, the lower end of the exhaust guide plate 8 should preferably be fixed to a bottom plate 24 of the housing 2, located below the heating chamber 4 to support the heating chamber. By this, since the upper end of the exhaust guide plate 8 is fixed to the top plate 43 of the heating chamber 4 as described above and the lower end of the exhaust guide plate 8 is to be fixed to the bottom plate 24 of the housing 2, the positional deviation of the exhaust guide plate 8 can be suppressed. The heating chamber 4 and the bottom plate 24 can be reinforced and an easy deformation of the heating chamber 4 and the bottom plate 24 can be suppressed even if a shock is applied from the outside of the housing 2.

Figure 5B:
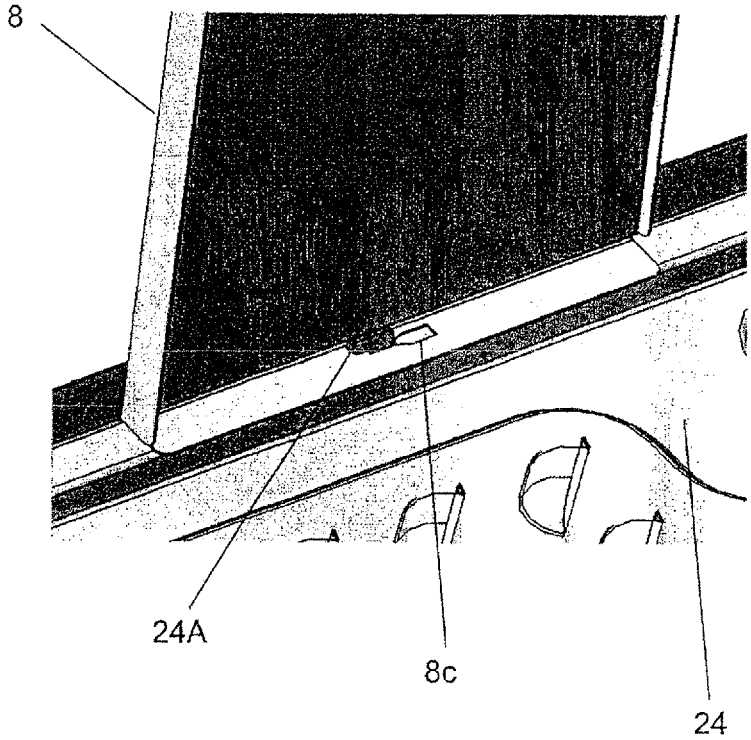
FIG. 5B is a perspective view of a second configuration example of fixing the lower end of the exhaust guide plate to the bottom plate of the housing.

A means of fixing the lower end of the exhaust guide plate 8 and the bottom plate 24 is not limited in particular but various means can be employed. The lower end of the exhaust guide plate 8 and the bottom plate 24 may be fixed by, for example, a fastening member such as a screw. The lower end of the exhaust guide plate 8 and the bottom plate 24 may be fixed by forming a hole 8C on the lower end of the exhaust guide plate 8 as well as forming a claw part 24A on the bottom plate 24 and inserting the claw part 24A into the hole 8C to be locked thereto, as shown in FIG. 5B.

Figure 6:
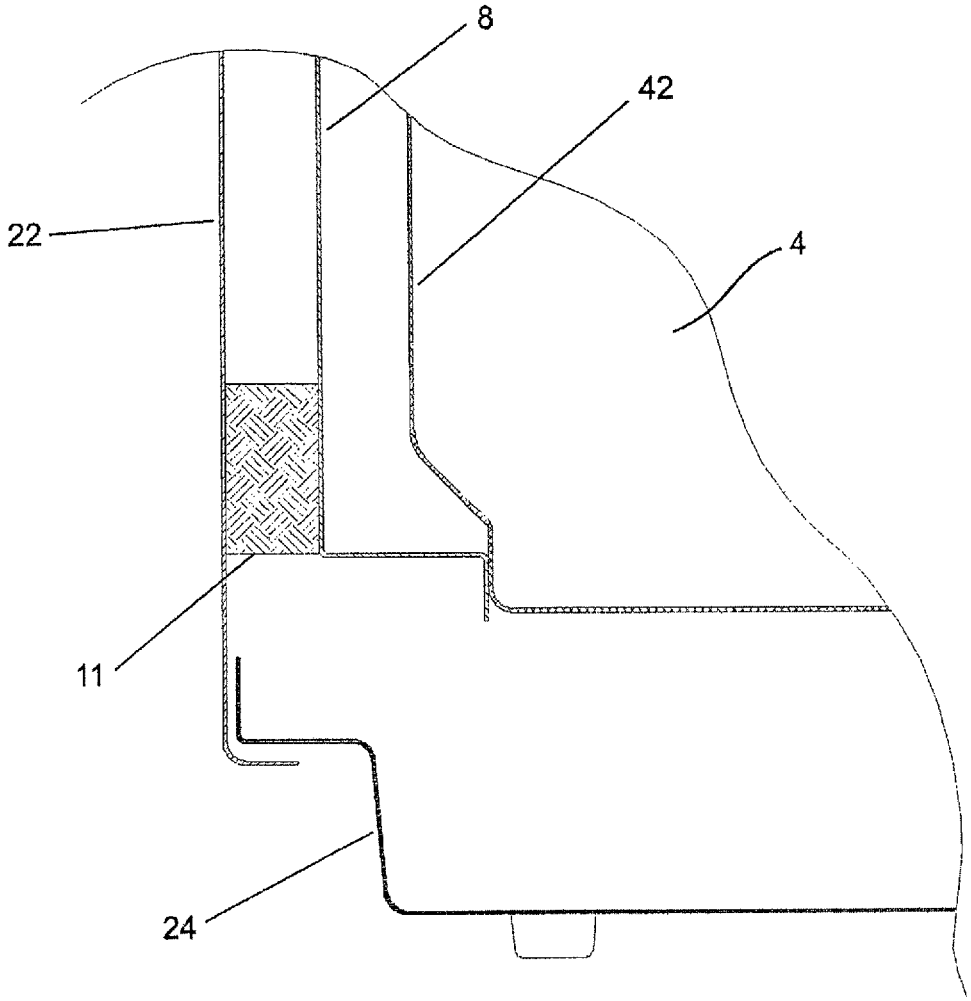
FIG. 6 is a cross-sectional view of a configuration example of disposing a spacer between the exhaust guide plate and a side plate of the housing.
Figure 7:
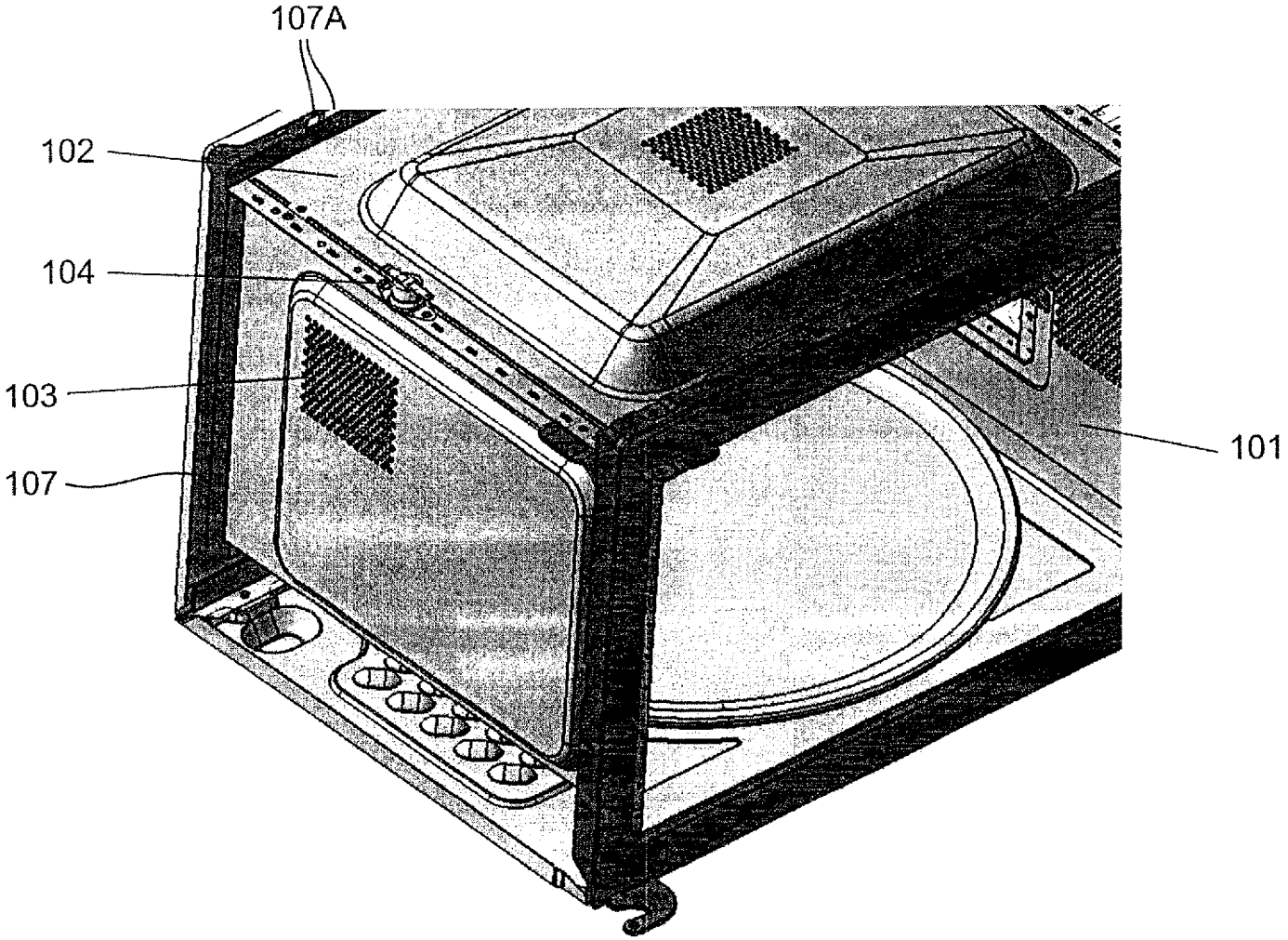
FIG. 7 is a perspective view of the internal structure of the high-frequency heating cooker of a first conventional example and is a diagram of a configuration of disposing an excessive temperature rise preventing device on a top plate of a heating chamber.

As shown in FIG. 6, between the exhaust guide plate 8 and the left side plate 22 of the housing 2, a spacer 11 may be disposed to press the exhaust guide plate 8 so that a part of the exhaust guide plate 8 will get in contact with the left side plate 42 of the heating chamber 4. The positional deviation of the exhaust guide plate 8 can be suppressed by such a configuration as well. For example, when a fan motor is used as the cooling device 6, it is possible that the heating chamber 4 vibrates and the left side plate 42 of the heating chamber 4 and the exhaust guide plate 8 get into contact with each other, resulting in generation of vibration noise. By contrast, according to the above configuration, the vibration noise can be suppressed by the spacer 11. An elastic material such as elastic rubber should preferably be used for the spacer 11. By this, the vibration noise can be suppressed further.

According to the high-frequency heating cooker of this embodiment, by providing the eaves structure above the excessive temperature rise preventing device 9, the attachment of the water to the excessive temperature rise preventing device 9 can be suppressed.

According to the high-frequency heating cooker of this embodiment, since the eaves structure to prevent the wetting of the excessive temperature rise preventing device 9 is configured by the concave part 8A of the exhaust guide plate 8, the eaves structure can be configured by a simple processing of disposing the concave part 8A in the exhaust guide plate 8.

Although the invention has been fully described in connection with the preferred embodiment thereof with reference to the accompanying drawings, it is to be noted that various changes and modifications are apparent to those skilled in the art. Such changes and modifications are to be understood as included within the scope of the invention as defined by appended claims unless they depart therefrom.

INDUSTRIAL APPLICABILITY

The high-frequency heating cooker according to the invention, being capable of suppressing the attachment of the water to the excessive temperature rise preventing device, is useful for the high-frequency heating cooker such as the microwave oven.

What is claimed is:

1. A high-frequency heating cooker comprising:

a housing;

a heating chamber disposed inside the housing to contain an heating-target object, the heating chamber having a first side plate and a second side plate;

a high-frequency generating device that generates a high-frequency wave to be supplied to the inside of the heating chamber;

a cooling device that blows air to cool the high-frequency generating device;

an exhaust guide plate that is disposed between the second side plate of the heating chamber and a side plate of the housing and guides the air discharged from the exhaust opening so that the air does not directly hit the side plate of the housing; and an excessive temperature rise preventing device that is disposed on the exhaust guide plate and detects an abnormal temperature rise inside the heating chamber to stop driving of the high-frequency generating device, wherein an air intake opening is disposed on the first side plate of the heating chamber and takes the air blown from the cooling device to cool the high-frequency generating device into the heating chamber, an exhaust opening is disposed on the second side plate confronting the first side plate of the heating chamber and discharges the air taken into the heating chamber from the air intake opening out of the heating chamber, and the exhaust guide plate has an eaves structure above the excessive temperature rise preventing device;

wherein, the exhaust guide plate has a concave part recessed to be close to the exhaust opening at a portion confronting the exhaust opening, and the excessive temperature rise preventing device is disposed on the concave part.

2. The high-frequency heating cooker according to claim 1, wherein a depth dimension of the concave part is larger than a height dimension of the excessive temperature rise preventing device.

3. The high-frequency heating cooker according to claim 1, wherein the concave part is formed to be recessed over an entire width in a width direction of the exhaust guide plate.

4. The high-frequency heating cooker according to claim 1, wherein the exhaust guide plate has a guide part that guides the air discharged from the exhaust opening toward an external exhaust opening disposed on a back plate of the housing.

5. The high-frequency heating cooker according to claim 1, wherein an upper end of the exhaust guide plate is fixed to the heating chamber, and a lower end of the exhaust guide plate is fixed to a bottom plate of the housing, located below the heating chamber to support the heating chamber.

6. The high-frequency heating cooker according to claim 1, further comprising:

a spacer that is disposed between the exhaust guide plate and the side plate of the housing and presses the exhaust guide plate so that a part of the exhaust guide plate comes into contact with the second side plate of the heating chamber.

* * * * *